United States Patent [19]

Kosmatka

[11] 3,971,329

[45] July 27, 1976

[54] MOORING DEVICE

[76] Inventor: Arthur J. Kosmatka, 7766 Honey Creek Parkway, Milwaukee, Wis. 53219

[22] Filed: July 19, 1974

[21] Appl. No.: 490,043

[52] U.S. Cl. ..... 114/230
[51] Int. Cl.[2] ..... B63B 21/16
[58] Field of Search..... 114/230, 206 R; 9/8 R, 9/8 P

[56] References Cited

UNITED STATES PATENTS

| | | | |
|---|---|---|---|
| 2,411,382 | 11/1946 | Martin | 114/230 |
| 2,581,676 | 1/1952 | Loaney | 114/230 |
| 3,063,402 | 11/1962 | Vallquist | 114/230 |
| 3,209,545 | 10/1965 | Cook | 9/8 P |
| 3,838,657 | 10/1974 | Fleming | 114/230 |

OTHER PUBLICATIONS

Popular Mechanics Magazine, vol. 106, No. 2, Aug. 1956, p. 160, Figure 7e.

*Primary Examiner*—Stephen G. Kunin
*Assistant Examiner*—Charles E. Frankfort
*Attorney, Agent, or Firm*—Cyril M. Hajewski

[57] ABSTRACT

A device for moving a boat from a dock with the boat being moored in the water a distance from the dock so that it will not be damaged by being tossed against the dock due to waves or choppy water. The boat is moved away from and to the dock by a mooring line which is attached to the front end of the boat. A second mooring line is provided having one end attached to the dock and extending under water about a pair of pulleys into securement with the rear end of the boat. With this arrangement of two separate mooring lines attached to separate ends of the boat, the latter can be safely anchored away from the dock and yet may be readily brought to the dock or moved away from it by a person standing on the dock.

2 Claims, 1 Drawing Figure

MOORING DEVICE

BACKGROUND OF THE INVENTION

When mooring a boat it is not only desirable, but when the boat is relatively large, it is essential that the boat be moved into open water, away from all rigid structures, such as a pier, if damage to the boat is to be avoided. If the boat is tied close to the dock, it will be tossed against the dock and eventually will be damaged, especially when high waves are caused by the weather or other conditions.

In order to achieve such open water mooring, it has been the practice to tie the boat to a buoy or float that is anchored in the open water. In order for a person to get to the dock, another vessel, such as a small boat, must be provided to carry the person from the moored boat to the dock and when reboarding the boat it must be reached by means of such other vessel.

It is therefore a general object of the present invention to provide a boat mooring device which will moor the boat in open water, away from the dock but will enable the person using the boat to secure the boat in open water while standing on a dock and to release the boat and return it to the dock without leaving the dock.

Another object of the present invention is to enable a person to manipulate a pair of mooring lines from a pier or other solid footing for securing a boat in open water and for returning the boat from the open water to the dock.

SUMMARY OF THE INVENTION

According to this invention, the improved mooring device for boats comprises two pulleys anchored in spaced relationship. One of the pulleys is disposed immediately adjacent to the dock and may be attached to the dock itself either above or below the water line. The second pulley is mounted on a bar or bracket that is firmly anchored under the water and is preferably a bar that is driven into the ground under the water. This second pulley is located a suitable distance from the dock and is preferably under the water. A mooring line is attached to the dock and extends about the first and second pulleys out into the water away from the dock. The extending end of this line is provided with a hook which can hook onto an eye or other similar structure that is mounted on the rear of the boat. This extending end is also provided with a float immediately adjacent to the hook to retain the hook at the top of the water, even when it is not attached to the boat.

A second mooring line is attached to the front end of the boat with its opposite end being attached to the dock. When it is desired to move the boat away from the dock the person draws the first line toward the pier after the hook has been attached to the boat. This pulls the boat away from the dock and the first line is tied to the dock to secure the boat in open water. The second line from the front end of the boat is likewise tied to the dock. To draw the boat toward the dock, the first line is untied from the dock so it can move outwardly therefrom, and the second line is then pulled to bring the boat up to the dock for boarding.

BRIEF DESCRIPTION OF THE DRAWING

The single FIGURE is a view in side elevation showing the improved boat mooring device of the present invention.

DESCRIPTION OF THE PREFERRED EMBODIMENT

Figure 1:
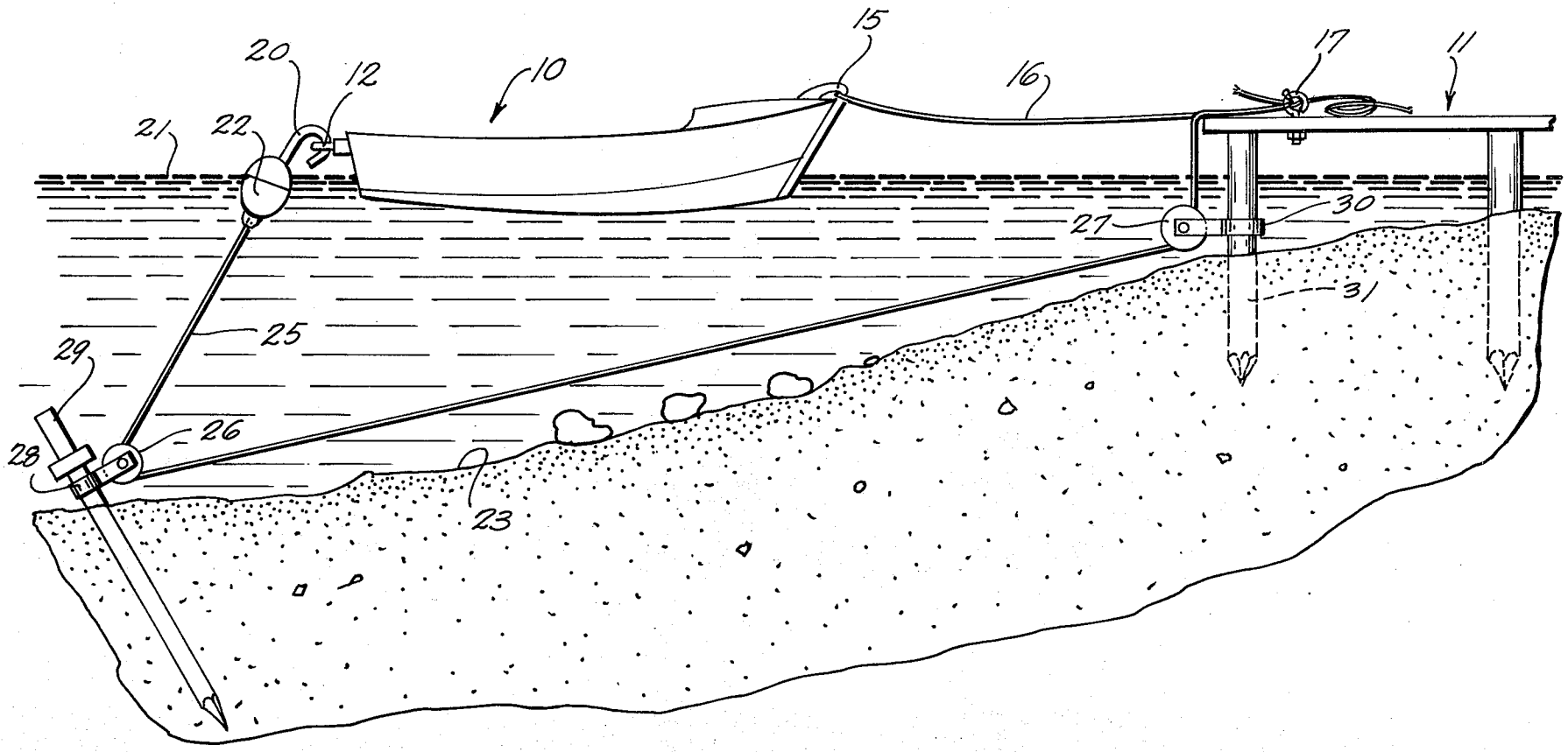

Reference is now made more particularly to the drawing which illustrates a boat 10 moored to a pier 11 by a mooring device constructed in accordance with the teachings of the present invention. The boat 10 is provided with a mooring eye 12 at its rear end and a mooring bracket 15 at its forward end. A line or cable 16 has one end attached to the bracket 15 and extends outwardly therefrom so that its opposite end may be tied to a mooring eye 17 which is rigidly secured to the pier 11.

A hook 20 is in engagement with the eye 12 at the rear end of the boat 10. When the hook 20 is disengaged from the eye 12 it is retained afloat above the water line 21 by a float 22. The broken line 21 in FIG. 1 represents the top of the water in which the boat 10 is floating while the line 23 in the FIGURE represents the bed of the water.

A line or cable 25 is securely attached to the float 22 and extends about a pair of pulleys 26 and 27. The pulley 26 is journalled in a bracket 28 that is mounted on a bar 29 that is driven a substantial distance into the ground below the bed 22 so that it is securely fixed to retain the pulley 26 adjacent to the bed of the water but at a distance remote from the pier 11.

On the other hand, the pulley 27 is journalled in a bracket 30 that is securely mounted on a support 31 of the pier 11. With this arrangement, the pulley 27 is therefore directly adjacent to the pier 11 and at a substantial distance from the pulley 26 and then about the pulley 27 to extend upwardly therefrom to the top of the pier 11 where it is also tied to the eye 17.

It will be noted that a substantial amount of the line 25 rests upon the pier 11 beyond its knot on the eye 17. Accordingly, when it is desired to pull the boat 10 to the pier 11, the operator merely unties the line 25 from the eye 17 and pulls on the line 16 to draw the boat 10 to the pier 11. Since the hook 20 is in engagement with the eye 12, this will cause the line 25 to draw away from the pier 11 and sufficient extra line is provided so that the line 25 remains extending through the eye 17. The person using the boat then disengages the hook 20 from the eye 12 and will pull the line 25 through the eye 17 onto the pier 11 so that the float 22 and its associated hook 20 will float directly above the pulley 26. The person then unties the line 16 from the eye 17 and the boat is free to be used upon the water.

When it is desired to again moor the boat, the person first engages the hook 20 with the eye 12 and then brings the boat 10 to the pier 11. The line 16 is securely tied to the eye 17 and the line 25 is then drawn through the eye 17 to thereby retract the boat 10 away from the pier 11 to approximately the position shown in FIG. 1. When the boat 10 is withdrawn a safe distance from the pier 11 the line 25 is tied to the eye 17 and the boat is then safely moored. Since it is then located a distance from the pier 10, inclement weather and the associated high waves will not damage the boat 10 by throwing it against the pier 11. The boat will be safely moored away from the rigid pier 11 and yet it is a simple matter to bring the boat back to the pier without the necessity of getting into another vessel to reach the boat 10.

From the foregoing detailed description of the illustrative embodiment of the invention set forth herein it will be apparent that there has been provided an improved mooring device for mooring boats a safe distance from the pier or dock and yet enables the person using the boat to moor the boat at this location remote from the pier and to bring it back to the pier very conveniently without getting into another vessel to reach the boat 10 when it is moored or to return to the pier 11 after mooring the boat at the remote location.

Although the illustrative embodiment of the invention has been described in considerable detail for the purpose of disclosing a practical operative structure whereby the invention may be practised advantageously it is to be understood that the particular mooring device is intended to be illustrative only and that the various novel characteristics of the invention may be incorporated into other structural forms without departing from the spirit and scope of the invention as defined in the subjoined claims.

The principles of this invention having now been fully explained in connection with the foregoing description, I hereby claim as my invention:

1. In a mooring device for mooring a boat in a body of water in the vicinity of a pier; a bar driven into the ground beneath the water at a distance from the pier; a first pulley rotatably supported by said bar with the pulley being fully submerged in the water and being disposed adjacent to the bed of the body of water; securing means on said pier for receiving lines that are secured to it; a first line having one end fastened to said securing means and passing about said pulley so that its opposite end is in the water at a distance from the pier; a float secured to said first line at said opposite end which is remote from the pier; a hook secured directly to said float at an end of said float opposite from said line so that said float will keep said hook at the surface of the water and will retain said line in engagement with said pulley; and a second line having one end tied to the boat and its opposite end tied to said securing means on the pier whereby said hook may be engaged with the boat to moor the boat at a distance from the pier but said first line may be released from said securing means so that the boat can be pulled toward the pier by drawing on said second line.

2. A mooring device according to claim 1 including a bracket mounted on the pier for rotatably supporting a second pulley adjacent to the pier and at a distance from said first pulley, and said first line passes from said float about both of said pulleys and into engagement with said securing means on said pier.

* * * * *